US010313800B2

(12) United States Patent
Deas

(10) Patent No.: US 10,313,800 B2
(45) Date of Patent: Jun. 4, 2019

(54) MEMS DEVICE

(71) Applicant: Cirrus Logic International Semiconductor Ltd., Edinburgh (GB)

(72) Inventor: James Thomas Deas, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/946,590

(22) Filed: Apr. 5, 2018

(65) Prior Publication Data

US 2018/0302727 A1 Oct. 18, 2018

Related U.S. Application Data

(60) Provisional application No. 62/485,250, filed on Apr. 13, 2017.

(51) Int. Cl.

| | |
|---|---|
| ***H04R 1/04*** | (2006.01) |
| ***H04R 19/04*** | (2006.01) |
| ***H04R 19/00*** | (2006.01) |

(52) U.S. Cl.

CPC ..... *H04R 19/04* (2013.01); *H04R 1/04* (2013.01); *H04R 19/005* (2013.01); *H04R 2201/003* (2013.01); *H04R 2410/05* (2013.01); *H04R 2499/11* (2013.01)

(58) Field of Classification Search

CPC ..... H04R 2201/003; H04R 19/005; H04R 19/04; H04R 2201/0257; H04R 2203/0127

See application file for complete search history.

(56) References Cited

U.S. PATENT DOCUMENTS

| | | | | |
|---|---|---|---|---|
| 2008/0192962 | A1* | 8/2008 | Halteren | H04R 1/222 381/170 |
| 2010/0280825 | A1* | 11/2010 | Takano | H04R 1/04 704/225 |
| 2012/0250897 | A1 | 10/2012 | Michel et al. | |
| 2016/0165357 | A1 | 6/2016 | Morishita et al. | |

OTHER PUBLICATIONS

Combined Search and Examination Report, UKIPO, Application No. GB1706641.6, dated Oct. 26, 2017.

* cited by examiner

*Primary Examiner* — James K Mooney
(74) *Attorney, Agent, or Firm* — Jackson Walker L.L.P.

(57) ABSTRACT

MEMS devices are disclosed including a MEMS microphone device comprising a first transducer adjoining a sound port, a second transducer not adjoining a sound port, a housing defining a shared volume for the first and second transducers, and circuitry arranged to combine a first signal from the first transducer and a second signal from the second transducer to produce an output signal.

17 Claims, 5 Drawing Sheets

MEMS DEVICE

TECHNICAL FIELD

Embodiments disclosed herein relate to MEMS devices, including devices that include MEMS transducers.

BACKGROUND INFORMATION

Consumer electronics devices are continually getting smaller and, with advances in technology, are gaining ever-increasing performance and functionality. This is clearly evident in the technology used in consumer electronic products and especially, but not exclusively, portable products such as mobile phones, audio players, video players, personal digital assistants (PDAs), various wearable devices, mobile computing platforms such as laptop computers or tablets and/or games devices. Requirements of the mobile phone industry, for example, are driving the components to become smaller with higher functionality and reduced cost. It is therefore desirable to integrate functions of electronic circuits together and combine them with transducer devices such as microphones and speakers. Micro-electro-mechanical system (MEMS) transducers, such as MEMS microphones, are therefore finding application in many of these devices.

Microphone or pressure sensor devices formed using MEMS fabrication processes typically comprise one or more membranes with electrodes for read-out/drive that are deposited on or within the membranes and/or a substrate or back plate. In the case of MEMS pressure sensors and microphones, the electrical output signal read-out is usually accomplished by measuring a signal related to the capacitance between the electrodes.

To provide protection the MEMS transducer will be contained within a package. The package effectively encloses the MEMS transducer and can provide environmental protection and may also provide shielding for electromagnetic interference (EMI) or the like. The package also provides at least one external connection for outputting the electrical signal to downstream circuitry. For microphones, pressure sensors and the like the package will typically have a sound port to allow transmission of sound waves to/from the transducer within the package, and the transducer may be configured so that the flexible membrane is located between first and second volumes, i.e. spaces/cavities that may be filled with air, and which are sized sufficiently so that the transducer provides the desired acoustic response. The sound port acoustically couples to a first volume on one side of the transducer membrane, which may sometimes be referred to as a front volume. The second volume, sometimes referred to as a back volume, on the other side of the one of more membranes is generally required to allow the membrane to move freely in response to incident sound or pressure waves, and this back volume may be substantially sealed. However, it will be appreciated by one skilled in the art that for MEMS microphones and the like the first and second volumes may be connected by one or more flow paths, such as small holes in the membrane, that are configured so as present a relatively high acoustic impedance at the desired acoustic frequencies but which allow for low-frequency pressure equalisation between the two volumes to account for pressure differentials due to temperature changes or the like.

The package may contain circuitry on the same or a separate semiconductor die as the membrane. The whose function of the circuitry is to measure a transducer signal related to the capacitance between the electrodes, and the circuitry may also provide one or more audio processing functions such as filtering, equalisation and the like. The integrated circuit may also provide bias to the electrodes, analog to digital conversion, analog or digital signal conditioning, an analog or digital output interface, and/or other functions.

The electrical transducer signal from the electrodes at normal sound levels is small, typically only a few millivolts. However, the supply voltage may have noise or ripple superimposed on it. For various reasons, a microphone may often be mounted at positions on the host device some way away from where the power supply voltage is generated, for example on the end of a long flex circuit to a corner of a device, or may be mounted for example under the antenna of a mobile phone where the supply voltage may be modulated by pulses of RF energy in the transmitted signal. In mobile phones, to save energy, it is common for major current-consuming blocks to be duty-cycled in operation to reduce average power consumption, for example in GSM phones with a duty-cycled RF transmitter, giving rise to time-varying changes in supply or ground connections despite reasonable attempts to mitigate these issues.

It is thus desirable to improve power supply rejection (PSR) performance of MEMS microphones such that variations and noise in a power supply voltage have little effect on any output signal from the integrated circuit. However, providing good power supply rejection has proven to be difficult to achieve in practice.

SUMMARY OF EMBODIMENTS

According to a first aspect, there is provided a MEMS microphone device comprising a first transducer adjoining a sound port; a second transducer not adjoining a sound port; a housing defining a shared volume for the first and second transducers; and circuitry arranged to combine a first signal from the first transducer and a second signal from the second transducer to produce an output signal.

In some embodiments, the circuitry is arranged to apply relative gains to first and second signals so as to provide equal and opposite contributions to the combined output signal from a pressure variation in the shared volume.

In some embodiments, the shared volume is a back volume for the first transducer and a front volume for the second transducer.

In some embodiments, the circuitry is arranged to combine the signals from the first and second transducers to reduce effects on the output signal of variations in pressure within the housing not caused by sound or pressure waves entering the sound port.

In some embodiments, the circuitry is arranged to combine the signals from the first and second transducers to reduce effects on the output signal of variations in power consumption of the integrated circuit.

In some embodiments, the circuitry includes at least one amplifier for amplifying at least one of the first signal and the second signal.

In some embodiments, the circuitry includes at least one signal processing circuit for processing at least one of the first signal and the second signal. The signal processing circuit may in some cases low-pass filter at least one of the first signal and the second signal.

In some embodiments, the circuitry combines the first and second signals using a subtractor.

In some embodiments, the circuitry is integrated on a same semiconductor die as the second transducer, and a back volume of the second transducer extends underneath circuitry integrated on the semiconductor die.

In some embodiments, a membrane of the first transducer is in a same layer as a membrane of the second transducer.

In some embodiments, the membrane of the first transducer includes a first electrode of the first transducer, the membrane of the second transducer includes a first electrode of the second transducer, the first transducer includes a second electrode, and the second transducer includes a second electrode in the same layer as the second electrode of the first transducer.

According to a second aspect, there is provided a MEMS microphone comprising: a package substrate comprising a sound port; a first MEMS transducer comprising a first membrane, the first MEMS transducer attached to the package substrate; a second MEMS transducer comprising a second membrane, the second MEMS transducer attached to the package substrate to provide an acoustically closed back volume for the second MEMS transducer; a cover attached to the package substrate so as to define a common volume for the first and second transducers; and wherein the first transducer membrane lies in a fluid flow path between the sound port and the common volume and the second transducer membrane lies in a fluid flow path between the common volume and the back volume.

In some embodiments, the device further comprises circuitry operatively arranged to combine signals from the first and second transducers to produce a combined output signal; wherein the circuitry is arranged to apply respective gains to first and second signals so as to provide equal and opposite contributions to the combined output signal from a pressure variation in the shared volume.

In some embodiments, the circuitry and the first transducer and the second transducer are integrated on a same semiconductor die.

In some embodiments, the second transducer is integrated on a same semiconductor die as integrated circuitry, and a back volume of the second transducer extends underneath the integrated circuitry on the semiconductor die.

According to a third aspect, there is provided a MEMS device comprising: a housing; a first transducer within the housing; a second transducer within the housing; circuitry within the housing; a port for allowing sound or pressure waves to interact with the first transducer; wherein the integrated circuit is arranged to utilise a first signal from the first transducer and a second signal from the second transducer to reduce the effects on the first signal of variations in pressure within the housing not caused by the sound or pressure waves.

According to a fourth aspect, there is provided a MEMS device comprising: a first MEMS transducer; a housing defining a volume in fluid flow communication with substantially a first side of a membrane of the first transducer; a port in fluid flow communication with substantially a second side of the membrane of the first transducer; a second MEMS transducer, wherein the volume is in fluid flow communication with substantially a first side of a membrane of the second transducer; and a circuitry [disposed within the volume], the circuitry configured to receive signals from the first transducer and the second transducer and to process the signals to reduce effects of variation of power consumption of the integrated circuit on the membrane of the first transducer.

According to a fifth aspect, there is provided a MEMS device comprising: a casing defining a volume; first and second transducers within the volume; wherein the first transducer is arranged to provide a signal such that an increase in pressure external to the device and an increase in pressure within the volume cause the first transducer to provide respective signals of opposite polarity; and wherein the second transducer is arranged such that an increase in pressure external to the device and an increase in pressure within the volume cause the second transducer to provide respective signals of the same polarity.

According to a sixth aspect, there is provided a MEMS device comprising: first and second transducers within a package structure having at least one acoustic port; a first transducer within the package structure having a membrane disposed between a first volume and a second volume, the first volume being in acoustic communication with an acoustic port; a second transducer within the package structure having a membrane disposed between the second volume and a third volume, wherein the third volume is not in acoustic communication with any acoustic port other than via the second volume.

According to a seventh aspect, there is provided an electronic apparatus comprising a transducer device according to any of the first to sixth aspects, wherein said apparatus is at least one of: a portable device; a battery power device; a computing device; a communications device; a gaming device; a mobile telephone; a personal media player; a laptop, tablet or notebook computing device.

BRIEF DESCRIPTION OF THE FIGURES

Embodiments will now be described by way of non-limiting example only with reference to the accompanying Figures, in which.

DETAILED DESCRIPTION OF EMBODIMENTS

Figure 1:
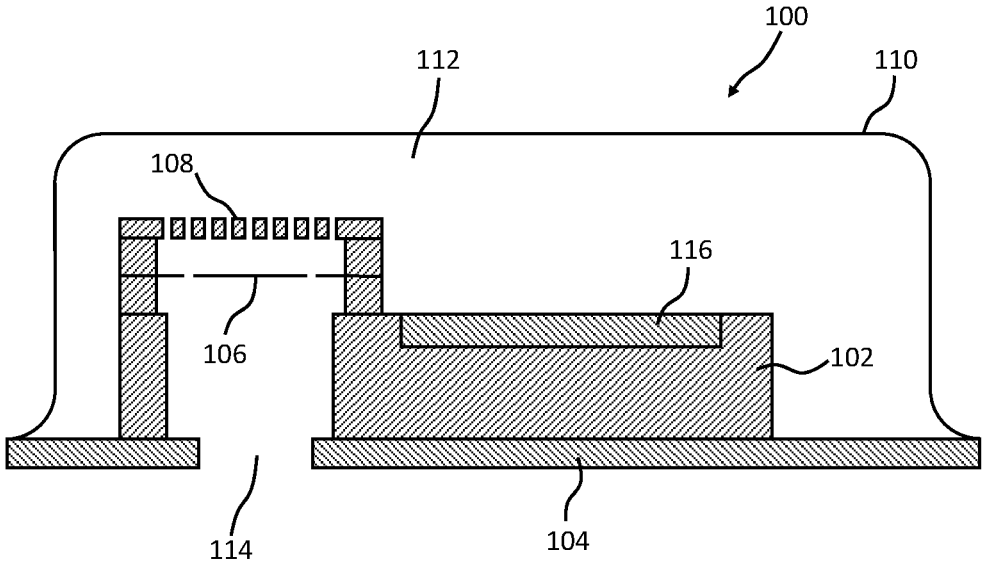
FIG. 1 illustrates a cross section of an example of a MEMS device.

FIG. 1 illustrates a cross-section of an example of a packaged MEMS microphone device 100. The device 100 includes a semiconductor die 102 mounted on a package substrate 104. The semiconductor die 102 includes both circuitry 116 and a co-integrated MEMS transducer including a membrane 106 and back plate 108. The membrane 106 and back plate 108 are positioned adjacent to and spaced apart from each other, and each includes an electrode (not shown), or is conductive and thus forms an electrode, such that they form the plates of a capacitor. Therefore, in this example, the semiconductor die 102 contains integrated circuitry 116 and a MEMS transducer structure. In other examples the MEMS transducer elements may be implemented on a separate semiconductor die.

The integrated circuitry 116 and MEMS transducer may be packaged in a number of ways. For example, as shown in FIG. 1, the semiconductor die 102 comprising the MEMS transducer is mounted on the package substrate 104 and covered by a lid 110 to define a volume 112 which may serve as for example the back volume of a MEMS microphone. In examples where the MEMS transducer is implemented as a separate semiconductor die the semiconductor die 102 and the MEMS transducer semiconductor die may be attached separately to a common package substrate and covered by a common lid to define a common volume. However, other packaging types may instead be used. For instance, in wafer-level chip-scale packaging (WLCSP) examples the package substrate 104 may be absent, and external connections may be made directly from the lower surface of a single semiconductor die incorporating the transducer and circuitry, with a lid structure mounted directly onto the die to provide a back volume.

In general for space reasons and structural simplicity there will be a common volume communicating with both the MEMS transducer and associated integrated circuitry whether or not these are integrated on a single die or a plurality of die, and whether or not the device comprises a separate package substrate.

The package substrate 104 includes an acoustic port 114 that may comprise a sound port of a MEMS microphone. The back plate 108 includes a plurality of holes that provide channels from the volume between the membrane 106 and the back plate 108 to the volume 112. The membrane 106 includes one or more holes to allow low frequency pressure equalisation between the volume 112 and the air surrounding the device 100.

In use, sound or pressure waves may enter the acoustic port 114 of the MEMS microphone device 100 and interact with the membrane 106, causing the membrane to move in a vertical direction as shown in FIG. 1, or to tend to move in this direction. In other words, the membrane may experience a force in a direction towards or away from the back plate 108, due to a sound or pressure wave. An incident sound pressure wave, for example, may thus cause the distance between the membrane 106 and back plate 108, and their associated electrodes, to change, and therefore the capacitance between the electrodes changes. This change in capacitance can be detected by the integrated circuitry 116, which may output an electrical output signal representing the sound or pressure waves that caused the movement of the membrane 100. Accordingly, the device 100 may include connections (not shown), such as metal interconnects, between the electrodes and the integrated circuitry 116.

Figure 2:
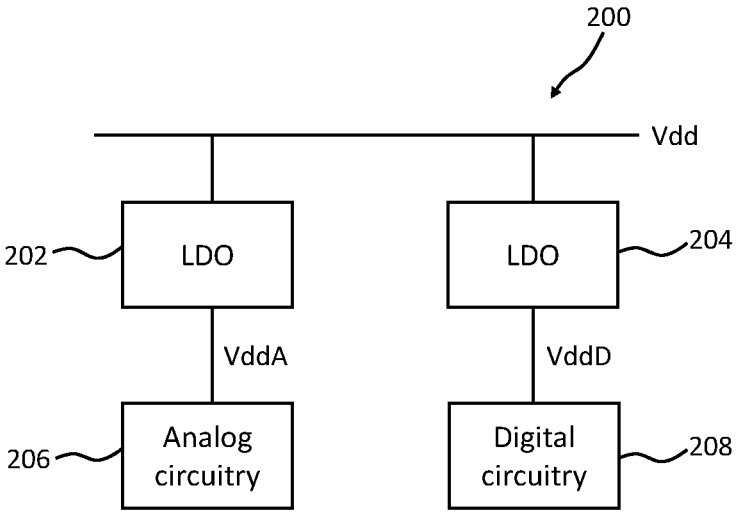
FIG. 2 illustrates an example of at least a portion of an integrated circuit.

FIG. 2 illustrates an example of at least some of the circuitry 200 that may be included in the semiconductor die 102. The circuitry 200 may include one or more voltage regulators such as low-dropout (LDO) regulators. Two LDO regulators 202 and 204 are shown in FIG. 2. Each LDO regulator receives a voltage, such as a power supply voltage Vdd, and outputs a substantially constant voltage to other parts of the circuitry. For example, the LDO regulator 202 receives voltage Vdd and provides a first regulated voltage (VddA) to analog circuitry 206. Similarly, the LDO regulator 204 receives the voltage Vdd and provides a second regulated voltage (VddD) to digital circuitry 208. In one example implementation, the voltage Vdd is 1.8V, the first regulated voltage is 1.6V, and the second regulated voltage is 1.0V, though other voltages may be used in other implementations.

The LDO regulators 202 and 204 provide respective substantially constant voltages, i.e. substantially constant supply voltages, to the associated analog and digital circuitry 206 or 208 even in the presence of power supply fluctuations and noise. Therefore, in some implementations, the current consumption of the integrated circuitry is substantially constant even with changes ΔVdd in power supply voltage Vdd. As a result, the power consumption of the integrated circuit circuitry, being the product of the supply voltage Vdd and the current flowing from the supply terminal to ground, is proportional to the supply voltage level Vdd and thus changes linearly with ΔVdd.

In other examples the supply voltage for at least some of the analog or digital circuitry may be derived without using LDOs but bias voltages for components in the circuitry may be generated so as to still result in substantially constant current draw by the circuitry 200. For example, a bias current may be generated using a substantially supply independent reference voltage such as a bandgap voltage. In still other examples, the current drawn by the circuitry may vary due to variations and noise in the supply voltage Vdd, and hence the power consumption of the circuitry 200 may vary non-proportionally to the supply voltage.

The circuitry 200 shown in FIG. 2 is merely an example and other implementations of the integrated circuitry may include more or fewer components, or different components, to those shown in FIG. 2. For example, the integrated circuitry may have more or fewer LDO regulators, or may have no LDO regulators, and may include analog circuitry and/or digital circuitry as appropriate. In at least some implementations, however, the power consumption depends on the supply voltage level, and may thus fluctuate with fluctuations and noise in the supply voltage level.

A problem with the device 100 of FIG. 1 is that in use, the integrated circuitry 116 consumes power and generates heat, at least some of which dissipates into the air in the back volume 112. As the power consumption changes due to fluctuations and noise in the power supply voltage level, the temperature of the air in the back volume 112 may thus increase and decrease. As a result, thermal expansion of the air in the back volume 112 may cause variation of the pressure in the back volume. Since the back volume is in acoustic communication with the membrane 116, this pressure is exerted on the membrane 106, resulting in movement of the membrane 106. This may be detected by the integrated circuitry 116 as a signal which may be indistinguishable from signals due to sound or pressure waves incident on the membrane via the acoustic port 114, particularly if the supply voltage modulation contains audio frequency components.

Figure 3:
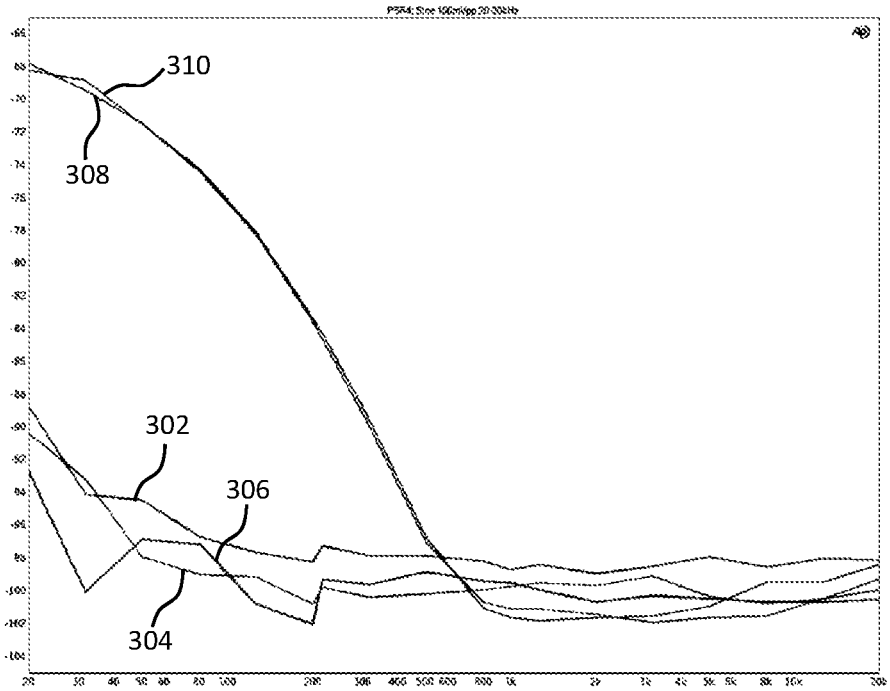
FIG. 3 illustrates an example of a chart illustrating performance of the device of FIG. 1 during testing.

FIG. 3 illustrates the power supply rejection (PSR) performance of an example MEMS microphone device similar to the device 100 of FIG. 1 during testing with no acoustic stimulus present but with a sine wave of variable frequency superimposed on the supply voltage. FIG. 3 shows the amplitude of the resultant signal coupled onto the electrical output against frequency of the superimposed sine wave. The lower three curves 302, 304 and 306 represent the device in a vacuum, whereas the upper two curves 308 and 310 represent the device in air. It can be seen that the coupled output signal amplitude is relatively low and substantially independent of frequency in a vacuum, whereas in air the coupled output signal amplitude begins to rise below around 1 kHz and rises considerably as the frequency is lowered, reaching around −68 dBFS at 20 Hz, compared to the residual level of less than −90 dBFS coupled in a vacuum.

The cause for this is the repeated heating and cooling of the air in the back volume 112 (in particular the air closest to the surface of circuitry 116) due to the increase and decrease in the power consumption of the integrated circuitry 116, resulting in thermal modulation of the air pressure in the whole back volume and thus movement of the membrane 106 at the associated frequency. In other words, there is thermoacoustic coupling between the integrated circuitry 116 and the membrane 106, as the movement of the membrane may be detected by the integrated circuitry 116 indistinguishably from any movement of the membrane due to similar acoustic or sound pressure waves received via the acoustic port 114.

The problems arising from the thermal expansion of the air in the back volume are exacerbated by requirement to minimise the size of this back volume, subject to mechanical clearances and acoustic impedance constraints, in order to reduce the board area and particularly the height of the MEMS microphone device.

Embodiments of the invention provide a MEMS device with a first transducer and a second transducer. Signals from the two transducers may be combined in such a manner as to at least reduce the impact of changes in pressure in the back volume that are not a result of sound or pressure waves entering the device through the sound port and interacting with the membrane of the first transducer. For example, changes in pressure of the back volume may be as a result of changes in power consumption of an integrated circuit causing heating or cooling of air in the back volume. Alternatively, however, changes in pressure of the back volume may be caused by other factors, such as acoustic coupling of noise from outside the MEMS microphone device through flexing of the housing or package lid for example. Embodiments of the invention may mitigate the effects of these problems.

Figure 4:
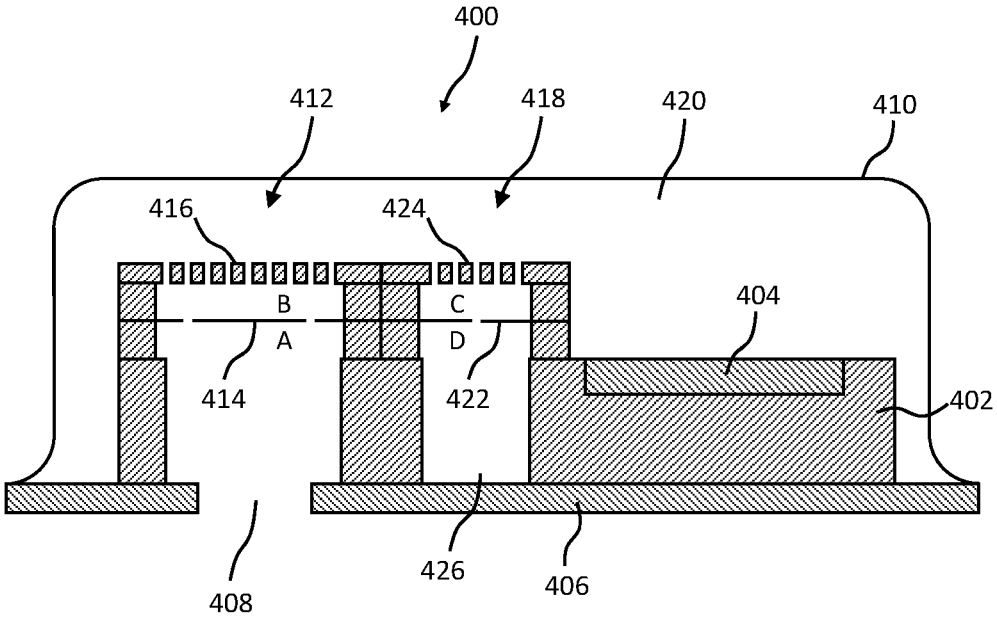
FIG. 4 illustrates an example of an embodiment of a MEMS device.

FIG. 4 illustrates an example of a MEMS device 400 such as a MEMS microphone. The device 400 includes a semiconductor die 402 with integrated circuitry 404, the semiconductor die 402 being mounted on a package substrate 406. The package substrate 406 includes an acoustic port 408, such as an opening or hole, for example, for allowing sound or acoustic pressure waves to enter the device. The device 400 shown also includes a lid 410. In this example the lid is attached to the package substrate, though other packaging types are possible. A volume 420 is defined by the space enclosed by the package substrate 406 and lid 410 not occupied by the semiconductor die 402.

The device 400 includes a first transducer 412. The first transducer 412 includes a membrane 414 that serves as or comprises or includes a first electrode (not illustrated), and a back plate 416 that serves as or comprises or includes a second electrode (not illustrated). The first transducer 412 is therefore a capacitive transducer. The first transducer 412 adjoins the port 408. That is, sound or pressure waves that enter the sound port interact with the first transducer 412. For example, since the first transducer 412 is placed over the port 408, the pressure or sound waves interact with substantially a first side A of the membrane 414 after entering through the port 408. In the example device 400 shown, the first side A of the membrane 414 faces the port 408. The second side B of the membrane 414 faces the volume 420. The membrane 414 will flex in response to the pressure difference between sides A and B, i.e. in response to the pressure differential between the acoustic port 408 and the volume 420. The membrane 414 may include one or more holes for low-frequency pressure equalisation between the volume 420 and the pressure surrounding the device 400.

As a result of the first transducer 412 being adjacent the port 408, and sound or pressure waves interacting with the membrane 414, the membrane 414 will flex and cause the capacitance of the first transducer to vary in response to the sound or pressure wave. The change in capacitance will be detected by the circuitry 404, which derives an electrical first output signal broadly indicative of an audio signal incident on the acoustic port 408, for example. More specifically, the first output signal will be indicative of the incident audio signal less any change in pressure in the volume 420, either due to the membrane flexing and compressing air in the volume 420 or other effects such as the thermal effects discussed above.

The device 400 also includes a second transducer 418. The second transducer includes a membrane 422 that serves as or comprises or includes a first electrode (not illustrated), and a back plate 424 that serves as or comprises or includes a second electrode (not illustrated). The second transducer 418 shares volume 420 with the first transducer. In other words, both the first transducer membrane 414 and the second transducer membrane 422 are in acoustic communication with the shared volume 420. However, the second transducer 418 is not directly adjoining a sound port, and is not directly affected by sound or pressure waves arriving at the device 400. In other words, the second transducer 418 is neither placed over, nor adjacent, the acoustic port 408, nor any other acoustic port, and is therefore not directly affected by sound or pressure waves arriving at the device 400. In the example shown, both first and second transducers 412 and 418 are mounted on the package substrate 406, with the first transducer 412 mounted over the port 408. The second transducer 418 is not mounted over an acoustic port.

One side C of membrane 422 faces the shared volume 420. The second side D of the membrane 422 faces a substantially acoustically sealed volume 426, which serves as a back volume for transducer 418. The membrane 422 will flex in response to the pressure difference between sides C and D, i.e. in response to the pressure differential between the volume 420 and volume 426.

In some embodiments, the membrane 422 of the second transducer 418 includes one or more holes for low-frequency pressure equalisation between the volumes on either side C and D of the membrane 422. Additionally or alternatively, the package substrate 406 may include one or more holes for low-frequency pressure equalisation between a volume adjacent to the membrane 422 and the air surrounding the device 400; any such hole is not considered to be an acoustic port as it will be configured to be narrow and/or long enough to present a high enough acoustic impedance to substantially prevent sound or pressure waves at frequencies of interest from interacting directly and/or substantially with the membrane 422.

Effectively, therefore, the second transducer 418 can be considered to be a transducer without an associated port, i.e. acoustic port 408, whereas the first transducer 412 spans either partially or completely the acoustic port 408.

Any pressure wave present in the volume 420 interacts with the membrane 422, which will flex and cause the capacitance of the second transducer to vary. The change in capacitance will be detected by the circuitry 404, which derives a second electrical audio signal broadly indicative of pressure variations in shared volume 420, though corrected by any pressure variation in back volume 426, due for example to compression of air in the back volume by the membrane flexing.

Figure 5:
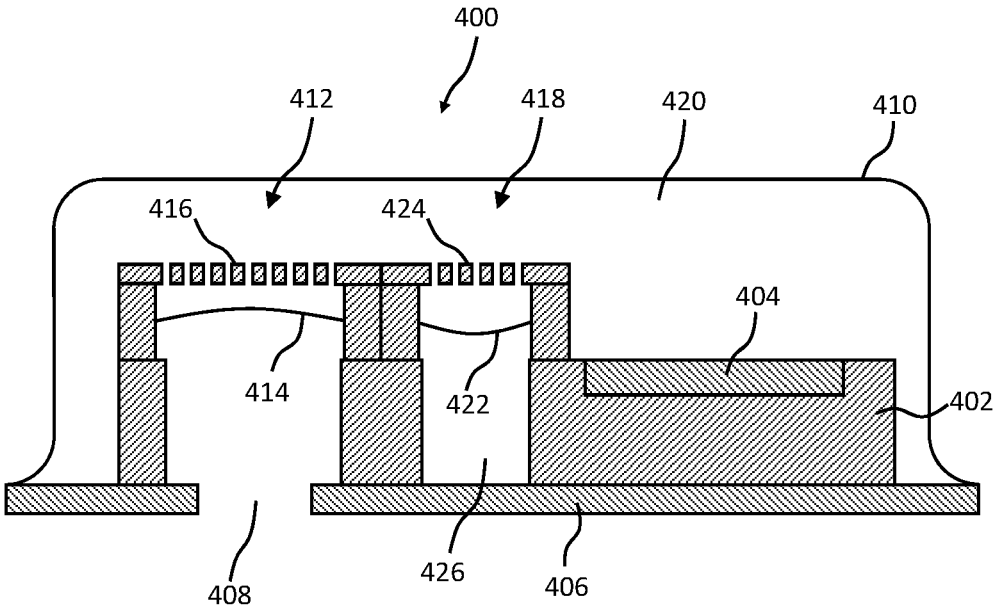
FIG. 5 illustrates an example of the MEMS device of FIG. 4 in a first scenario.

FIG. 5 illustrates an example of the device 400 operating in response to an increase in pressure external to the device 400, e.g. MEMS microphone. A sound or pressure wave has entered the port 408 and has interacted with the membrane 414 of the first transducer 412, pushing it towards the back plate 416 and increasing the capacitance of the first transducer 412. This is one example and in other examples, the configuration may be different. For example, the positions of the membrane 414 and back plate 416 may be switched, such that a pressure increase leads to a decrease in capacitance of the first transducer 412.

In the example shown, movement of the membrane 414 towards the back plate 416 also leads to air in shared volume 420 being compressed and hence an increase in pressure in the volume 420. In turn, this causes the membrane 422 of the second transducer 418 to be pushed away from the back plate 424, thus decreasing the capacitance of the second transducer 418. This is one example and in other examples, the configuration may be different. For example, the positions of the membrane 422 and back plate 424 may be switched, such that this scenario leads to an increase in capacitance of the second transducer 418.

Subsequent movement of the membranes 414, 422 in the opposite directions, due to a decrease in pressure external to the device 400, may then cause the capacitance of the first transducer 412 to decrease and that of the second transducer to increase, and so on. These respective capacitance changes of the first transducer 412 and second transducer 418 over time may each be detected by the circuitry 404 of the semiconductor die 402, which may use the detected capacitance changes to obtain respective first and second signals.

Figure 6:
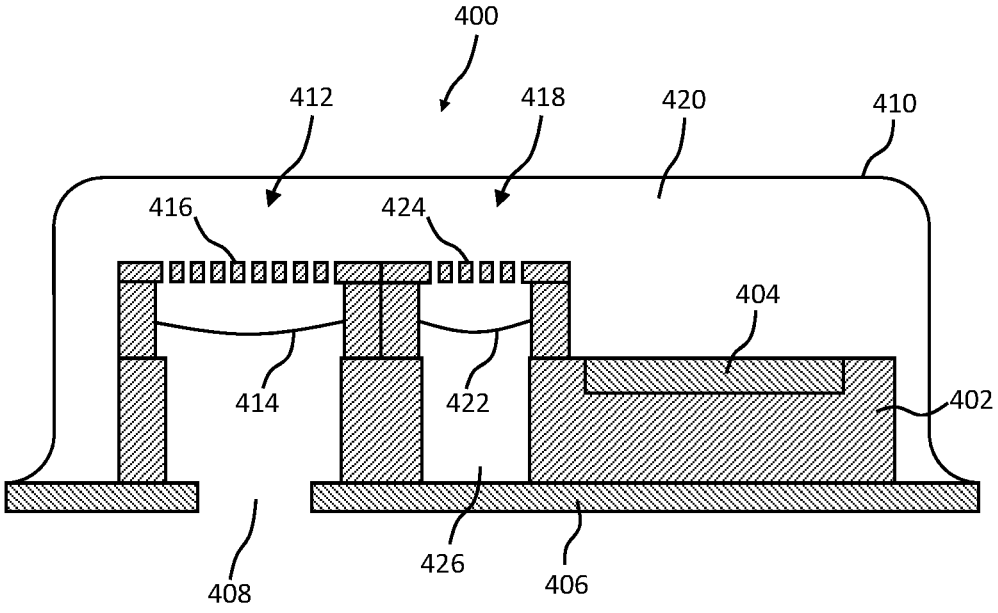
FIG. 6 illustrates an example of the MEMS device of FIG. 4 in a second scenario.

FIG. 6 illustrates an example of the device 400 in response to an increase in pressure within the shared volume 420 not caused by a sound or pressure wave entering the port 408. This increase in pressure may be as a result of, for example, an increase in power consumption of the circuitry 404 of the semiconductor die 402, causing the circuitry 404 to produce more heat, at least some of which is dissipated into the air in the volume 420 to produce temperature variations and consequent thermally induced pressure variation. The power consumption variation may be as a result of an increase in the power supply voltage provided to the circuitry 404. As shown, each membrane 414 and 422 has been displaced away from its respective back plate 416 and 424. Similarly, the membranes 414 and 422 will be displaced in the same opposite direction in response to a decrease in pressure within the volume 420 not caused by external pressure or sound waves.

The membrane 414 of the first transducer 412 is therefore displaced in one direction in response to an increase in pressure external to the device 400, and in the opposite direction in response to an increase in pressure of the shared volume 420 not caused by an external pressure or sound wave. The capacitance of the first transducer therefore increases or decreases depending on the origin of the pressure increase. In contrast, a pressure increase in shared volume 420 will displace the membrane 422 of the second transducer 418 regardless of the origin of the pressure increase.

Therefore, based on whether the detected movement of the membranes is in the same or opposite directions, i.e. based on the relative polarity of respective detected changes in capacitance, the device 400 is advantageously able to distinguish between movement of the membranes as a result of external pressure or sound waves, and movement of the membranes as a result of a pressure change within the volume 420 that is not as a result of external pressure or sound waves.

The device 400 may include circuitry to combine signals derived from the capacitances of the transducers 412 and 418. The combined signals can reduce the effect of changes in pressure within the shared volume 420 not resulting from external pressure or sound waves. As indicated above in respect of FIG. 1, for example, such changes in pressure in the shared volume may be misinterpreted as an audio signal. Embodiments of the present invention may combine the signals derived from the transducers 412 and 418 to cancel out the effects of such internal pressure changes on an output signal from the device 400.

In the example shown in FIGS. 4-6, an external sound or pressure wave results in signals from the transducers 412 and 418 having opposite polarity, and unrelated pressure changes within the volume 420 result in signals of the same polarity. Therefore, subtraction of one signal from the other may result in a signal where signals from external sound or pressure waves constructively combine, whereas signals from internal pressure changes unrelated to external sound or pressure waves destructively combine, and hence in the resulting signal the effects of the unrelated pressure changes in the volume 420 are reduced.

Figure 7:
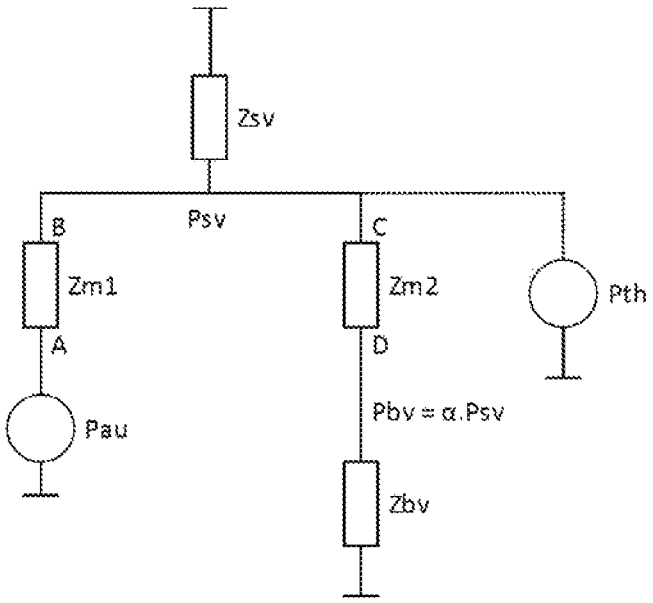
FIG. 7 illustrates an example of a model of the example MEMS devices shown in FIGS. 4-6.

FIG. 7 illustrates a simplified model of operation of examples shown in FIGS. 4 to 6. Impedance Zm1 represents the membrane 414 of the first transducer 412, with side A coupled to a source Pau representing acoustic waves incident on the acoustic port and side B to a node representing the shared volume with pressure Psv. Impedance Zsv represents the acoustic impedance of the shared volume. Impedance Zm2 represents the membrane 422 of the second transducer 418, with side C coupled to the shared volume and side D to a node representing the second transducer 418 back volume, with pressure Pbv.

Any modulation of Psv, whether due to incident acoustic stimulus Pau or to some other cause, will be imposed on side C of the second transducer membrane. The second transducer 418 back volume will present some resistance (illustrated as impedance Zbv) to membrane 422 movement, as movement of the membrane 422 will tend to compress air in the back volume of the second transducer 418. Thus only a fraction of the pressure Psv, say a fraction $1-\alpha$, will appear as a pressure difference across the membrane 422 while the remaining fraction $\alpha$ will appear as a modulation of pressure in the back volume of the second transducer 418. On the other hand, application of the same modulation of Psv to side B of the first membrane 414 will result in the full amount of this modulation appearing across the first membrane 414, since the open acoustic port 408 will offer little resistance to the first membrane's movement. The electrical signal derived from each membrane is proportional to each membrane's respective pressure difference, thus the electrical signal derived from the second transducer 418 will be attenuated by a factor $1-\alpha$ relative to that derived from the first transducer 412.

Similarly, any movement of the first membrane 414 due to modulation of the applied acoustic pressure source Pau will result in compression of the air in the shared volume, albeit shunted somewhat by compression of air in the second transducer 418 back volume via the impedance Zm2 of the second membrane 422, so a fraction of Pau, for example a fraction $\beta$, will appear in the shared volume, i.e. on side B of the first membrane 414, resulting in an attenuation $1-\beta$ in the pressure difference appearing across the first membrane 414. Meanwhile the second membrane 422 will experience a pressure difference of a fraction $1-\alpha$ of the modulation of Psv, i.e. a fraction $(1-\alpha)\cdot\beta$ of Pau.

Thus in order to cancel the effect of any disturbance of the pressure in the shared volume not due to a stimulus at the acoustic port 408, the second signal must be scaled by a factor $1/(1-\alpha)$ before subtraction from the signal from the first signal (ignoring any other scaling factors that may also need to be applied if the inherent sensitivity of the second transducer 418 is different from the first transducer 412 due to size or construction or electrical bias differences).

Such a scaling factor will also scale any component of the second transducer signal due to acoustic port stimulus Pau by the same factor $1/(1-\alpha)$, resulting in a signal component corresponding to a pressure $\beta \cdot$Pau appearing on the output. Thus the composite signal will have a component proportional to $\beta \cdot$Pau due to the second transducer 418 and a component $(1-\beta) \cdot$Pau due to the first transducer 412 appearing on the output, which will constructively add, as discussed above, to provide an output independent of the pressure attenuation factor $\beta$.

In some examples, the factors $\alpha$ and $\beta$ may be frequency dependent, and/or a model may include phase, delay and/or non-linear components, and therefore analysis and modelling of such examples may be more complex.

Figure 8:
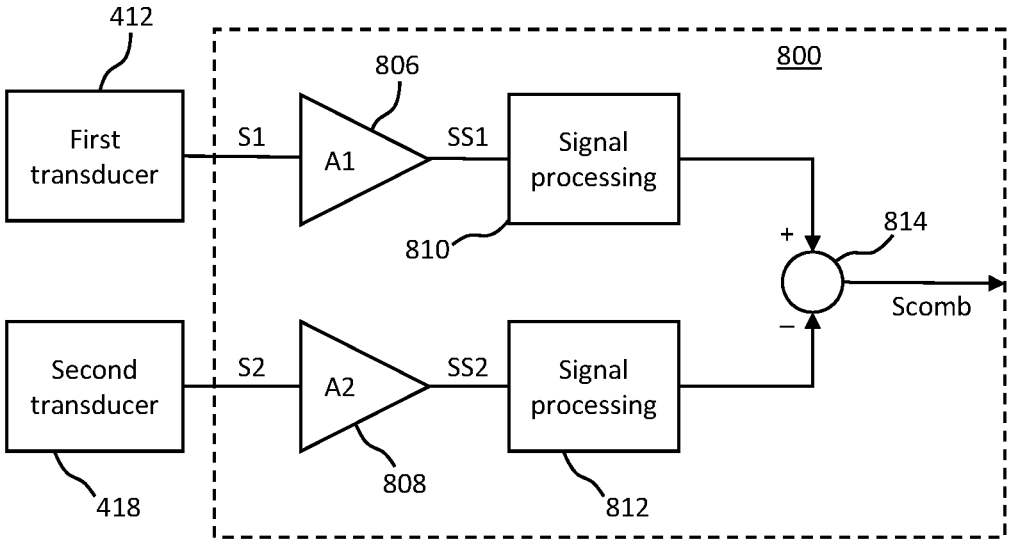
FIG. 8 illustrates an example of circuitry according to one embodiment.

FIG. 8 illustrates an example of circuitry 800 that may be used to combine signals from the transducers 412 and 418. The circuitry 800 may be integrated in the circuitry 404 in some embodiments, or may be implemented in whole or in part elsewhere. The circuitry 800 includes amplifiers 806, 808 coupled to respective first and second transducers 412, 418 to accept respective signals S1 and S2 indicative of the varying capacitances of the transducers 412, 418 and derive scaled respective scaled signals SS1 and SS2 subjected to respective gains A1 and A2 of amplifiers 806, 808. These scaled signals SS1 and SS2 may then be subject to further signal processing, for example band-limiting, frequency response equalisation or pre-emphasis, or analog-to-digital conversion, by first signal processing circuit 810 and second signal processing circuit 812 respectively, before being subtracted by element 814, which may be for example an analog difference amplifier or a digital subtractor, to provide combined output signal Scomb.

As discussed above, the gains A1 and A2, and any signal gain in the signal processing blocks (possibly complex or frequency dependent or amplitude dependent) applied to the transducer signals, may be arranged to compensate for the different pressure attenuations (and possibly other transducer-related gain mismatches due for example to size or construction or electrical bias differences) so as to provide equal and opposite contributions to the combined output signal from a pressure variation in the shared volume, along with a separate independent contribution due to any signal applied at the acoustic port.

In some embodiments, a low pass filter (not illustrated) may be present in the signal path from the second transducer 418, such as for example within signal processing circuitry 812 or as a separate module, to remove high frequency noise from the signal, in particular where the second transducer 418 is smaller in size than the first transducer 412 and hence generating more thermal noise. It is also noted from FIG. 3 that the problem of reduced power supply rejection (PSR) performance due to changes in power consumption of the integrated circuitry is generally limited in the example given to frequencies below around 600-1000 Hz, and thus limiting a signal derived from the second transducer 418 to generally lower frequencies is unlikely to have a significant impact on the operation of embodiments of the invention. In some embodiments, the signal processing applied to the first transducer signal may include a gain boost above the low-pass filter cut-off frequency to compensate for the lack of contribution of the acoustic signal component from the second transducer above this frequency.

Figure 9:
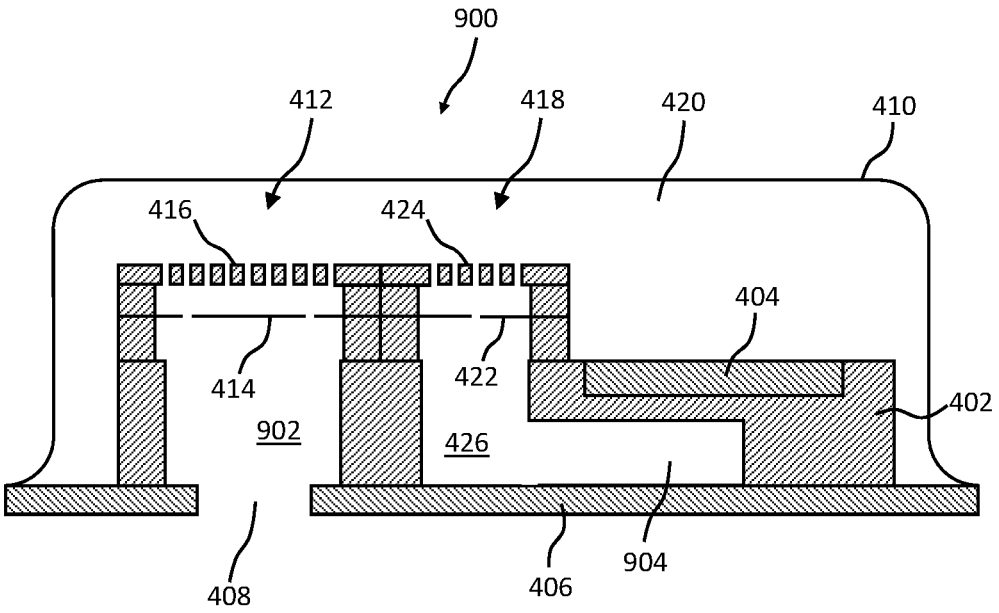
FIG. 9 illustrates another example of an embodiment of a MEMS device.

FIG. 9 illustrates a further example of a device 900. Features similar to those shown in FIGS. 4-6 are given the same reference numerals. The transducers 412 and 418 in the examples shown share a volume 420. Therefore, for example, the opposite volume 902 of the first transducer 412, which can be termed the "front volume," is adjoining (e.g. is in fluid flow communication with) the port 408. The back volume 426 of the second transducer 418 is not adjoining a port and is substantially sealed, save for any holes that may be present for low-frequency pressure equalisation with the shared volume 420. The size of the back volume 426 of the second transducer 418 influences the sensitivity of the second transducer 418, as a smaller back volume 426 may reduce the amount of movement that the membrane 422 can undergo due to pressure changes in the back volume 426 as a result of this movement. As such, the embodiment shown in FIG. 9 increases the back volume 426 of the second transducer 418 by including a portion 904 that is located underneath at least part of the circuitry 404 of the semiconductor die 402. That is, part of the bulk of the semiconductor die 402 that does not include any of the circuitry 404 has been removed to provide an additional volume 904 and increase the volume 426. As a result of the additional volume 804, the sensitivity of the second transducer 418 may be increased, and thus a signal derived from the second transducer 418 may be less sensitive to noise, and/or any amplifier and/or low-pass filter in a signal path from the second transducer may be omitted in some embodiments.

In these and other embodiments, a volume between the port 408 and the first transducer 412 may be referred to as a first volume, the shared volume 420 may be referred to as a second volume, and the back volume 426 on the other side of the second transducer 418 (labelled as 802 in FIG. 8) may be referred to as a third volume. These three volumes may not be in substantial fluid flow communication with each other, or where holes allow for low-frequency pressure equalization, these three volumes may not be in substantial fluid flow communication with each other at frequencies of interest, such as at audible frequencies.

In the above examples, certain components may be located in a single layer. For example, the membranes of the first and second transducers may be in the same layer, and/or the back plates of the transducers may be in the same layer, when the first and second transducers are integrated into a single semiconductor die. As a result, any components that are in the same layer can be fabricated in the same processing steps without requiring any additional steps. For example, in some embodiments, producing the second transducer along with the first transducer requires no additional steps compared to fabrication of the first transducer in FIG. 1.

In the embodiments shown, the first and second transducer and the integrated circuitry are shown as a single integrated semiconductor die, which is fabricated in a single process. However, in other embodiments other arrangements are possible. For example, the transducers may be produced as a single semiconductor die and brought together with the integrated circuitry implemented as one or more further semiconductor die into a package, casing, housing or the like. In some other embodiments, one of the transducers may be integrated with the integrated circuitry while the other is a separate semiconductor die, while in further embodiments the transducers and integrated circuitry may be all implemented as separate semiconductor die.

Embodiments of the invention may be implemented on one or more semiconductor die, and within integrated circuit packages such as those including a package substrate and lid, or other types of packages. Furthermore, the circuits or devices may be included within other devices, such as a laptop computer, desktop computer, tablet computer, mobile telephone and the like.

In the above examples, a power supply voltage Vdd and ground are given as being connected to particular nodes. However, in some embodiments these may be interchanged or replaced by other voltages, such as first and second voltages. Additionally or alternatively, where a component is indicated to be connected between two nodes, this is intended to indicate that the component is connected directly between these nodes, or alternatively in series with other circuit components.

The skilled person will recognise that at least some aspects of the above-described apparatus and methods may be embodied as processor control code, for example on a non-transitory storage or carrier medium such as a disk, CD- or DVD-ROM, programmed memory such as read only memory (Firmware), or on a data carrier such as an optical or electrical signal carrier. For some applications, embodiments will be implemented on a DSP (Digital Signal Processor), ASIC (Application Specific Integrated Circuit) or FPGA (Field Programmable Gate Array). Thus the code may comprise conventional programme code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

It should be noted that the above-mentioned embodiments are illustrative rather than limiting embodiments, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

What is claimed is:

1. A MEMS microphone device comprising:

a first MEMS capacitive transducer adjoining a sound port;

a second MEMS capacitive transducer not adjoining the sound port;

a housing defining a shared volume for the first and second MEMS capacitive transducers; and circuitry arranged to combine a first signal from the first MEMS capacitive transducer and a second signal from the second MEMS capacitive transducer to produce an output signal, wherein the circuitry is arranged to apply a first gain to the first signal and to apply a second gain to the second signal so as to provide equal and opposite contributions to the output signal from a pressure variation in the shared volume arising from variations in power consumption of the circuitry.

2. The device of claim 1, wherein the shared volume is a back volume for the first transducer and a front volume for the second transducer.

3. The device of claim 1, wherein the circuitry is arranged to combine the signals from the first and second transducers to reduce effects on the output signal of variations in pressure within the housing not caused by sound or pressure waves entering the sound port.

4. The device of claim 1, wherein the circuitry includes at least one amplifier for amplifying at least one of the first signal and the second signal.

5. The device of claim 1, wherein the circuitry includes at least one signal processing circuit for processing at least one of the first signal and the second signal.

6. The device of claim 5, wherein the signal processing circuit low-pass filters at least one of the first signal and the second signal.

7. The device of claim 1, wherein the circuitry combines the first and second signals using a subtractor.

8. The device of claim 1, wherein the circuitry is integrated on a same semiconductor die as the second transducer, and a back volume of the second transducer extends underneath circuitry integrated on the semiconductor die.

9. The device of claim 1, wherein a membrane of the first transducer is in a same layer as a membrane of the second transducer.

10. The device of claim 9, wherein:

the membrane of the first transducer includes a first electrode of the first transducer, the membrane of the second transducer includes a first electrode of the second transducer;

the first transducer includes a second electrode; and the second transducer includes a second electrode;

wherein the second electrode of the second transducer is in the same layer as the second electrode of the first transducer.

11. The device of claim 1, wherein the first transducer is arranged to provide a signal such that an increase in pressure external to the device and an increase in pressure within the shared volume cause the first transducer to provide respective signals of opposite polarity; and wherein the second transducer is arranged such that an increase in pressure external to the device and an increase in pressure within the volume cause the second transducer to provide respective signals of the same polarity.

12. An electronic apparatus comprising a device as claimed in claim 1, wherein said apparatus is at least one of: a portable device; a battery power device; a computing device; a communications device; a gaming device; a mobile telephone; a personal media player; a laptop, tablet or notebook computing device.

13. A MEMS microphone comprising:

a package substrate comprising a sound port;

a first MEMS transducer comprising a first membrane, the first MEMS transducer attached to the package substrate;

a second MEMS transducer comprising a second membrane, the second MEMS transducer attached to the package substrate to provide an acoustically closed back volume for the second MEMS transducer;

a cover attached to the package substrate so as to define a common volume for the first and second transducers; and wherein the first transducer membrane lies in a fluid flow path between the sound port and the common volume and the second transducer membrane lies in a fluid flow path between the common volume and the back volume;

wherein the MEMS microphone further comprises circuitry arranged to combine a first signal from the first MEMS capacitive transducer and a second signal from the second MEMS capacitive transducer to produce an output signal, wherein the circuitry is arranged to apply a first gain to the first signal and to apply a second gain to the second signal so as to provide equal and opposite contributions to the output signal from a pressure variation in the shared volume arising from variations in power consumption of the circuitry.

14. The MEMS microphone of claim 13, wherein the circuitry and the first transducer and the second transducer are integrated on a same semiconductor die.

15. The MEMS microphone of claim 13, wherein the second transducer is integrated on a same semiconductor die as integrated circuitry, and the acoustically closed back volume for the second transducer extends underneath the integrated circuitry on the semiconductor die.

16. An electronic apparatus comprising a MEMS microphone as claimed in claim 13, wherein said apparatus is at least one of: a portable device; a battery power device; a computing device; a communications device; a gaming device; a mobile telephone; a personal media player; a laptop, tablet or notebook computing device.

17. A MEMS device comprising:

a housing;

a first transducer within the housing;

a second transducer within the housing;

circuitry within the housing;

a port for allowing sound or pressure waves to interact with the first transducer;

wherein the circuitry is arranged to utilise a first signal from the first transducer and a second signal from the second transducer to reduce the effects on the first signal of variations in pressure within the housing arising from variations in power consumption of the circuitry.

* * * * *